US011851251B2

(12) United States Patent
Lewandowski et al.

(10) Patent No.: US 11,851,251 B2
(45) Date of Patent: Dec. 26, 2023

(54) MECHANISM FOR OPENING AND RECLOSING THE OUTFLOW OPENING FOR EMPTYING A CONTAINER, ESPECIALLY A BEVERAGE CONTAINER

(71) Applicant: REEND SPOLKA Z OGRANICZONA ODPOWIEDZIALNOSCIA, Krzemieniewo (PL)

(72) Inventors: Dariusz Lewandowski, Warsaw (PL); Roman Sobecki, Gostyn (PL)

(73) Assignee: REEND SPOLKA Z OGRANICZONA ODPOWIEDZIALNOSCIA, Krzemieniewo (PL)

( * ) Notice: Subject to any disclaimer, the term of this patent is extended or adjusted under 35 U.S.C. 154(b) by 0 days.

(21) Appl. No.: 17/926,798

(22) PCT Filed: Aug. 21, 2020

(86) PCT No.: PCT/PL2020/000071
§ 371 (c)(1),
(2) Date: Nov. 21, 2022

(87) PCT Pub. No.: WO2021/235952
PCT Pub. Date: Nov. 25, 2021

(65) Prior Publication Data

US 2023/0136489 A1 May 4, 2023

(30) Foreign Application Priority Data

May 22, 2020 (PL) ..... 434033

(51) Int. Cl.
*B65D 47/28* (2006.01)

(52) U.S. Cl.
CPC ..... *B65D 47/286* (2013.01)

(58) Field of Classification Search
CPC .... B65D 47/286; B65D 47/28; B65D 47/268; B65D 47/263
See application file for complete search history.

(56) References Cited

U.S. PATENT DOCUMENTS 1,975,481 A 10/1934 Schneible
6,354,454 B1 * 3/2002 Wong ..... B65D 47/263 215/322

(Continued)

FOREIGN PATENT DOCUMENTS

WO 2010094793 A2 8/2010
WO 2014003586 A2 1/2014
WO 2015185829 A1 12/2015

OTHER PUBLICATIONS

Written Opinion of the International Searching Authority and International Search Report issued by European Patent Office for corresponding International Patent Application No. PCT/PL2020/000071, dated Feb. 24, 2021.

*Primary Examiner* — Andrew T Kirsch
(74) *Attorney, Agent, or Firm* — MYERS WOLIN, LLC

(57) ABSTRACT

A mechanism for opening and reclosing the outflow opening for emptying a container, especially a beverage container, incorporating a latch to open and reclose the said outflow opening in the container lid, where the latch is fitted with hatching elements connected slidingly to the container lid, and where the lid features technical means suitable for moving the lid, characterised in that it contains at least one pair of sliding surfaces (3, 103), each of them incorporating at least one section in the shape of a convex arch, where moving on the said pair of sliding surfaces (3, 103) when shifting the latch (6, 106) is at least one pair of hatching elements (7, 107), and where ends (3*a*, 3*b*, 103*a*, 103*b*) of (Continued)

the sliding surfaces (3, 103) are positioned at different heights with respect to the bottom surface of the lid (1, 101) around the opening (2, 102).

7 Claims, 15 Drawing Sheets

(56) References Cited

U.S. PATENT DOCUMENTS

| | | | | |
|---|---|---|---|---|
| 6,824,003 | B1 | 11/2004 | Wong | |
| 7,850,037 | B2 * | 12/2010 | Schmidtner ..... | B65D 43/0208 220/717 |
| 2006/0081633 | A1 | 4/2006 | Schmidtner et al. | |
| 2019/0256258 | A1 | 8/2019 | Levy et al. | |

* cited by examiner

MECHANISM FOR OPENING AND RECLOSING THE OUTFLOW OPENING FOR EMPTYING A CONTAINER, ESPECIALLY A BEVERAGE CONTAINER

CROSS REFERENCE TO RELATED APPLICATIONS

The present application is a U.S. National Phase under 35 U.S.C. 371 of International Patent Application Serial No. PCT/PL2020/000071, filed on Aug. 21, 2020, which claims priority to Polish Application P. 434033, filed on May 22, 2020, the contents of each of which are incorporated by reference in their entirety for all purposes.

FIELD OF THE INVENTION

The present disclosure relates to a mechanism for opening and reclosing the out-flow opening for emptying a container, especially a beverage container. In particular, the mechanism is intended for containers made of plastic.

BACKROUND

Known from patent document WO 2014/003586 A2 is a reclosing mechanism for containers, particularly beverage containers, incorporating means for opening and reclosing the beverage outflow opening in the form of a latch fitted slidingly on the guides, where the latch touches on the bottom surface of the lid around the opening. On the top, the lid is fitted with a sliding pull tab on one side connected to the latch via a hinge and on the other connected to the latch via a connector which serves as the seal before the first opening, where on the side of the hinge and the pull tab front the lid features respective resistance surfaces which determine the initial position of the latch before the first opening.

Known from patent document WO 2010/094793 A2 is a container lid, particularly of a beverage can, incorporating a reclosing mechanism of elastic material, fixed entirely to the bottom side of the cover and partially integrated therewith in a way which prevents its twisting, featuring an actuating mechanism fitted on the top side of the lid via an adapter. When the actuating mechanism is moved, the part of the reclosing mechanism which covers the opening swivels in the plane perpendicular to the surface of the lid. The opening can be reclosed by moving the actuating mechanism.

SUMMARY

The present invention disclosure solves the problem of friction between the elements which mutually cooperate when opening and reclosing the outflow opening for emptying a container by reducing the friction; at the same time the invention ensures tight reclosing of the said opening. Reduced friction increases reliability of the functioning mechanism, reduces the risk of damaging it, and eliminates generation of minute particles in consequence of abrasion of the cooperating surfaces, where the particles may contaminate the container content, e.g. beverage.

Another purpose of the invention is to reduce the number of structural elements in the mechanism and simplify the technological processes of their production and assembly, which will translate to substantially lower manufacturing costs.

The problem has been solved by developing the mechanism structure which will additionally ensure optimal flow of beverage through the outflow opening when emptying the container.

A mechanism for opening and reclosing the outflow opening for emptying a container, especially a beverage container, incorporating a latch to open and reclose the outflow opening in the container lid, where the latch is fitted with hatching elements connected slidingly to the container lid, and where the lid features technical means suitable for initiating movement of the latch, according to the invention is characterised in that it contains at least one pair of sliding surfaces, each of them incorporating at least one section in the shape of a convex arch, where moving on the said pair of sliding surfaces when shifting the latch is at least one pair of hatching elements, and where ends of the sliding surfaces are positioned at different heights with respect to the bottom surface of the lid around the opening so that the end of each sliding surface, from which the movement of the latch starts towards the opening of the outflow opening, is positioned higher than its other end, and where the latch in the closed position contacts the bottom surface of the lid around the outflow opening, and in the open position is distant from the bottom surface of the lid.

Preferably, the mechanism contains two pairs of sliding surfaces positioned one after another in the direction of movement of the latch, and two pairs of hatching elements, where one pair of the hatching elements cooperates with one pair of the sliding surfaces.

Preferably, the sliding surface of at least one pair is made up of two sections in the shape of a convex arch each.

Preferably, there are longitudinal ribs formed on the bottom surface of the lid, and there is an end part formed on the latch and placed in between the said ribs of the lid so that a slit is formed between the lid and the end part of the latch.

Preferably, formed on the bottom surface of the lid is at least one pair of distancing elements, and the latch features at least one distancing element on its bottom surface, where the distancing element of the latch cooperates with the said pair of the distancing elements of the lid.

Preferably, there is an element to initiative movement of the latch formed on the top surface of the latch.

Preferably, the latch is fitted with an additional sealing and actuating element connected to the said element which initiates movement of the latch, preferably in the form of a tongue or cap.

Preferably, the mechanism is made of plastic.

The mechanism for opening and reclosing of an outflow opening for emptying a container according to the invention serves the intended purposes. Thanks to the inclination of the convex arched surfaces which guide the latch hatchers when opening and reclosing the outflow opening for emptying a container with respect to the bottom edge of the outflow opening, the latch gets instantly moved away from the bottom surface of the lid when the movement of the latch intended to open the outflow opening is initiated, which eliminates the effect of friction between the latch and the bottom surface of the lid, and enables instant release of air from the container, which makes it possible to use the mechanism in containers for highly pressurized and strongly carbonated beverages. Instant moving away of the latch from the lid when the movement of the latch is initiated facilitates the movement of the latch. The structure of the mechanism makes it possible to simplify the processes of mechanism production and assembly, which reduces substantially the costs of mechanism manufacturing.

Moreover, the solution according to the invention is characterised by a high level of intuitiveness and ergonomics when opening and reclosing the outflow opening. All elements of the lid may be produced of the same material as the container, which is important in terms of recycling of waste containers.

The mechanism according to the invention is used in lids of various shapes, carton boxes included, and may be produced using the existing methods of moulding and assembling.

BRIEF DESCRIPTION OF THE DRAWINGS

The invention embodiments are shown on a drawing, where.

DETAILED DESCRIPTION OF THE PREFERRED EMBODIMENTS

Figure 3:
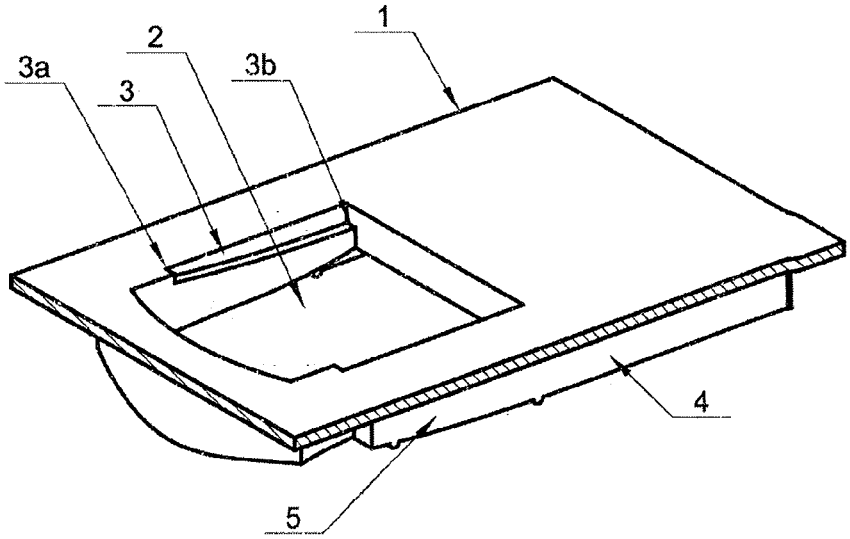
FIG. 3—shows the part of the lid with the opening for emptying the container, for the latch as in FIG. 1 and FIG. 2, in a 3D view from the top.
Figure 4:
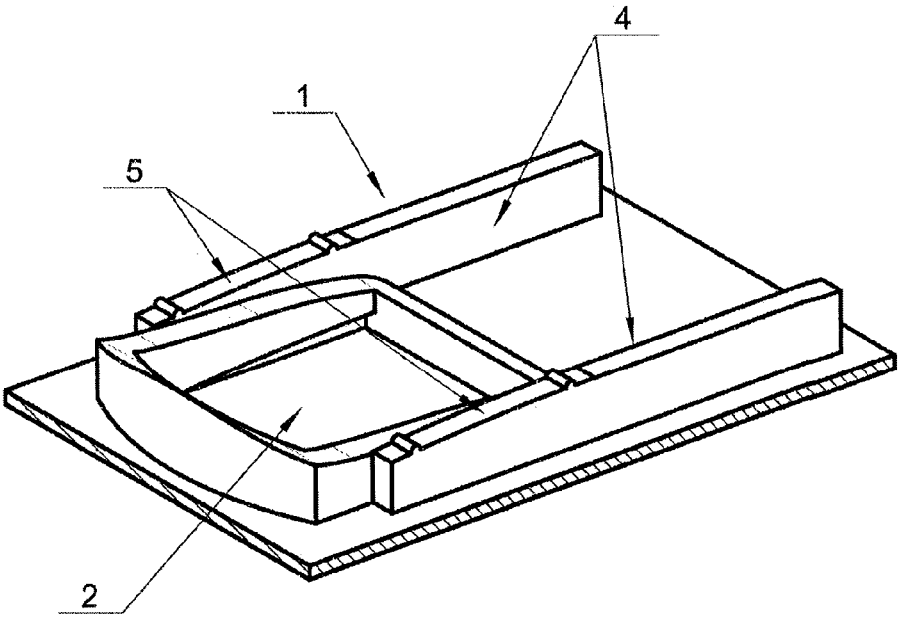
FIG. 4—shows the part of the lid with the opening for emptying the container, as in FIG. 3, in a 3D view from the bottom.
Figure 5:
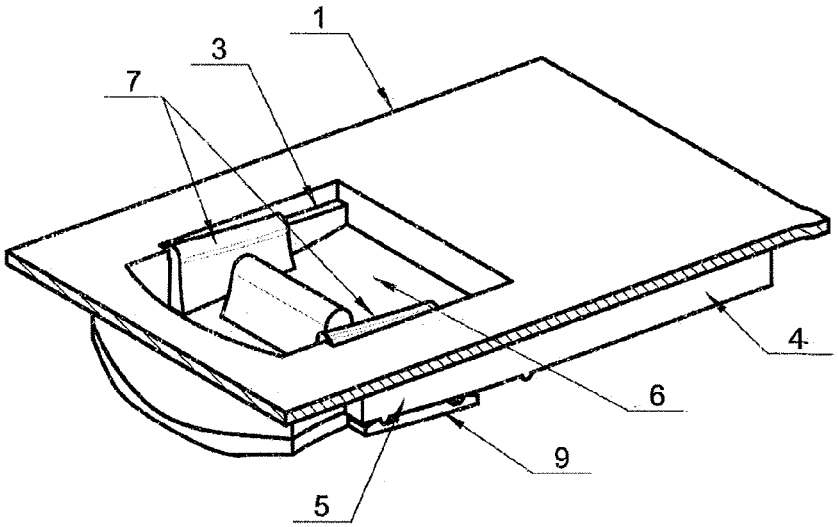
FIG. 5—depicts the mechanism incorporating the latch as in FIG. 1 and FIG. 2, fitted on the lid as in FIG. 3 and FIG. 4, in closed position, in a 3D view from the top.
Figure 6:
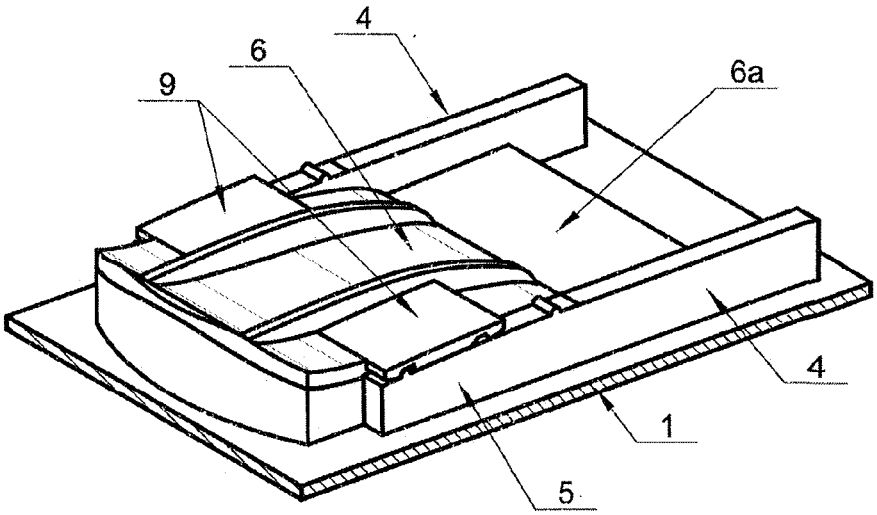
FIG. 6—presents the mechanism in the closed position, as in FIG. 5, in a 3D view from the bottom.
Figure 7:
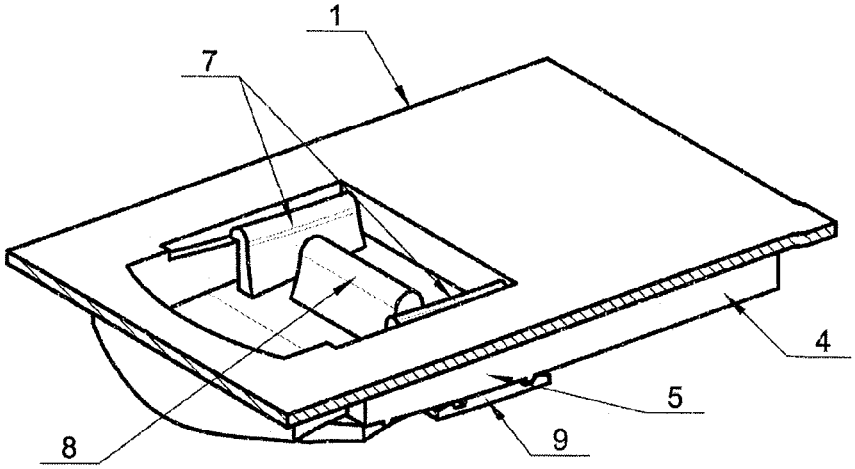
FIG. 7—presents the mechanism incorporating the latch as in FIG. 1 and FIG. 2, fitted in the lid as in FIG. 3 and FIG. 4, in the open position, in a 3D view from the top.
Figure 8:
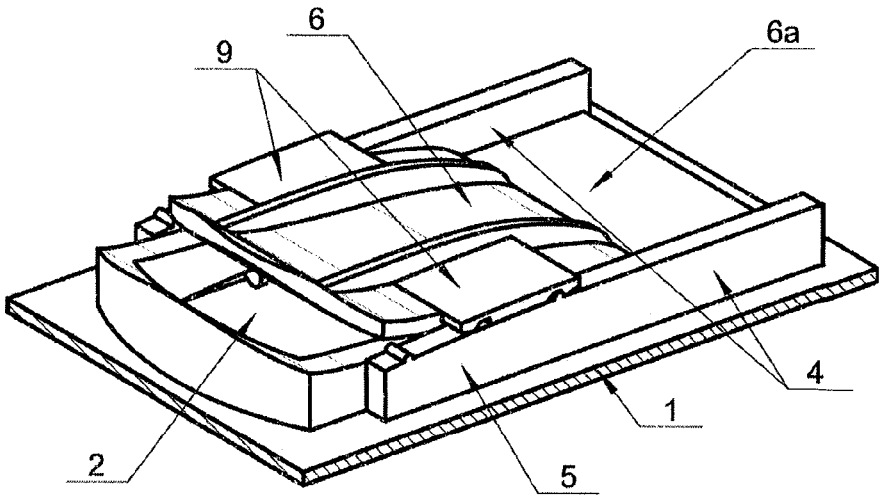
FIG. 8—presents the mechanism incorporating the latch as in FIG. 1 and FIG. 2, fitted in the lid as in FIG. 3 and FIG. 4, in the open position, in a 3D view from the bottom.
Figure 9:
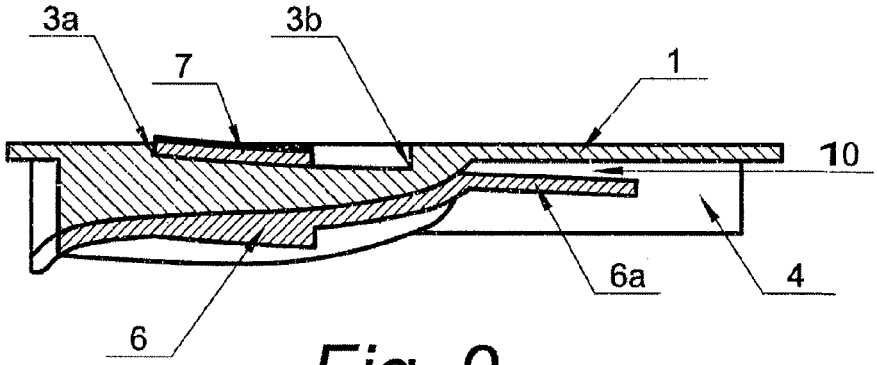
FIG. 9—shows the mechanism in the closed position, as in FIG. 5 and FIG. 6, in cross-section along the opening.
Figure 11:
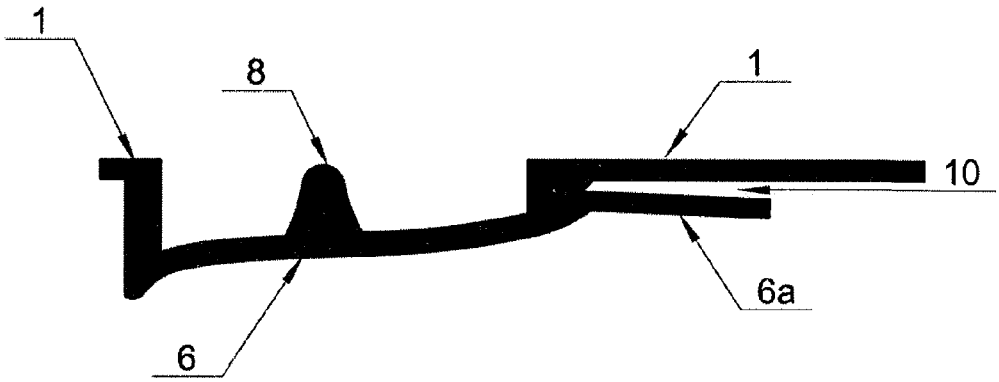
FIG. 11—presents a schematic cross-section of the mechanism in the closed position, as in FIG. 5 and FIG. 6.
Figure 12:
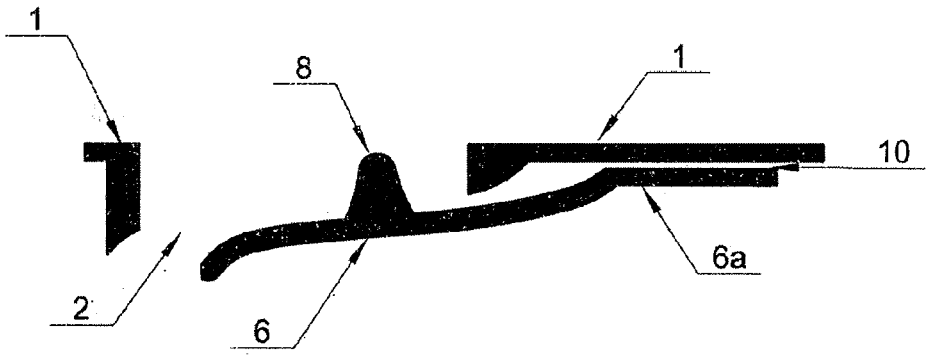
FIG. 12—presents a schematic cross-section of the mechanism on the open position, as in FIG. 7 and FIG. 8.
Figure 13:
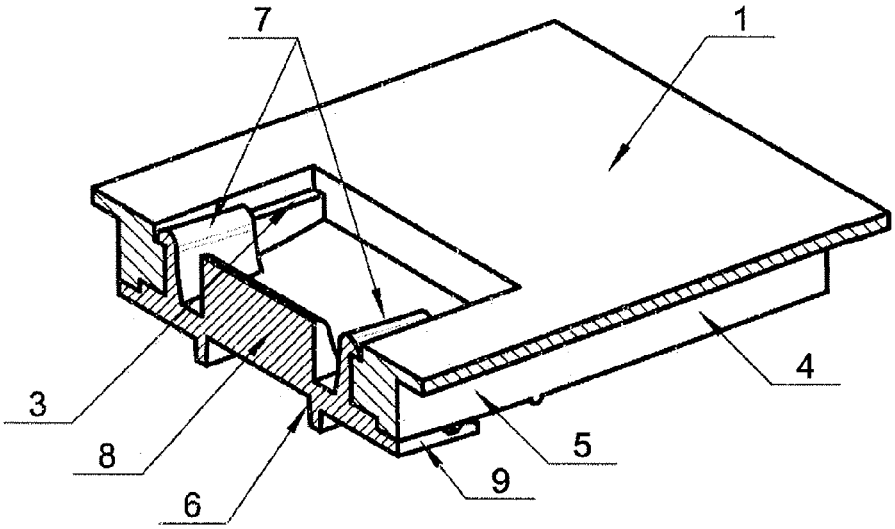
FIG. 13—depicts the mechanism in the closed position, as in FIG. 5 and FIG. 6, in a 3D cross-section across the opening.
Figure 14:
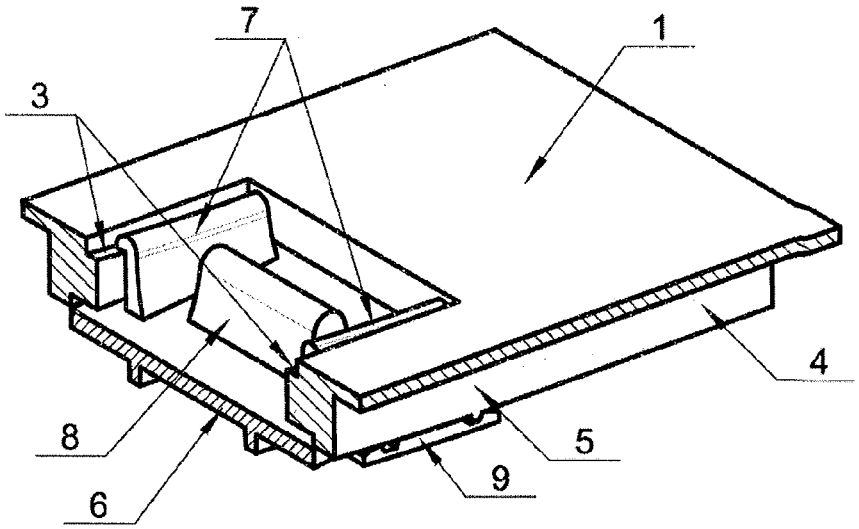
FIG. 14—depicts the mechanism in the open position, as in FIG. 7 and FIG. 8, in a 3D cross-section across the opening.

According to the first embodiment of the invention presented in FIG. 1 to FIG. 18, a mechanism for opening and reclosing the outflow opening 2 for emptying a container incorporates a latch 6 for opening and reclosing the said outflow opening 2 in the lid 1 of the container. The latch 6 is fitted with a single pair of hatching elements 7, and the lid 1 features a single pair of sliding elements 3 formed on the side longitudinal walls of the opening 2 (as shown in FIG. 3), or on the top surface of the lid 1 along the top longitudinal edges of the opening 2 (not shown on the drawing). The pair of the hatching elements 7 is fitted slidingly on the said sliding surfaces 3, which serve as guides for the hatching element 7 when the latch 6 is in motion. The sliding surfaces 3 are parallel to each another and are given the shape of a convex arch, in addition they are formed so that their ends are positioned at different heights with respect to the bottom surface of the lid 1 around the opening 2, where the ends 3*a* from which the movement of the latch 6 starts towards the opening of the outflow opening 2 are positioned higher than their other ends 3*b,* i.e. at a slope down in the direction in which the latch 6 moves towards the open position. When in the closed position, the latch 6 contacts the bottom surface of the lid 1 around the opening 2, as shown in FIG. 9, FIG. 11, and FIG. 13, and when in the open position, it is distant from the bottom surface of the lid 1, as sown in FIG. 10, FIG. 12, and FIG. 14.

Figure 10:
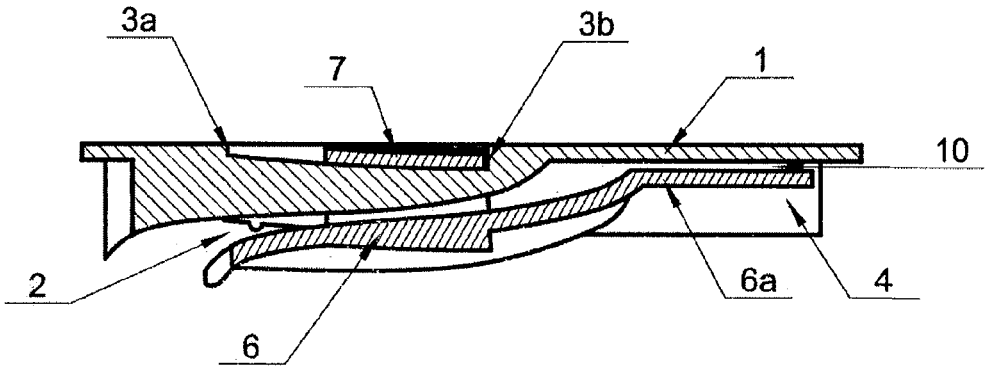
FIG. 10—shows the mechanism in the open position, as in FIG. 7 and FIG. 8, in cross section along the opening.

Formed on the bottom surface of the lid 1 are longitudinal ribs 4, where positioned in between the ribs is the end part of the latch 6*a,* so that between the lid 1 and the end part of the latch 6, in between the said ribs 4, formed is a slit 10 to supply air to the container during its emptying, as shown in FIG. 10.

Formed on the bottom surface of the lid 1 is a pair of longitudinal distancing elements 5 extending from the longitudinal ribs 4, and formed on the bottom surface of the latch 6 is a pair of transverse distancing elements 9 which cooperate with the said longitudinal pair of the distancing elements 5 of the lid 1.

Figure 1:
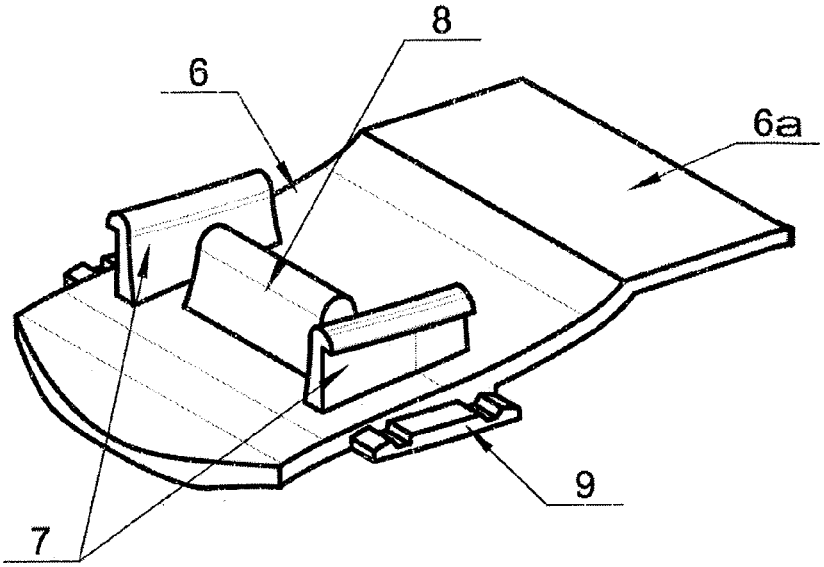
FIG. 1 presents the latch in a 3D view from the top, with a single pair of hatching elements.
Figure 2:
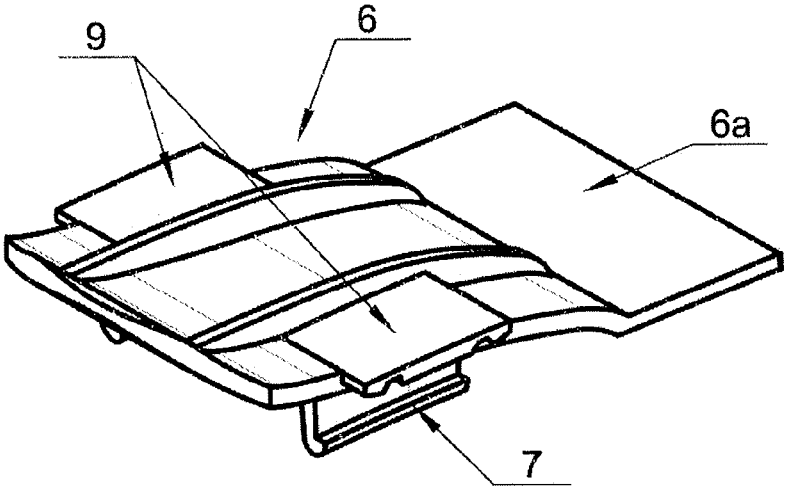
FIG. 2—presents the latch as in FIG. 1, in a 3D view from the bottom.
Figure 15:
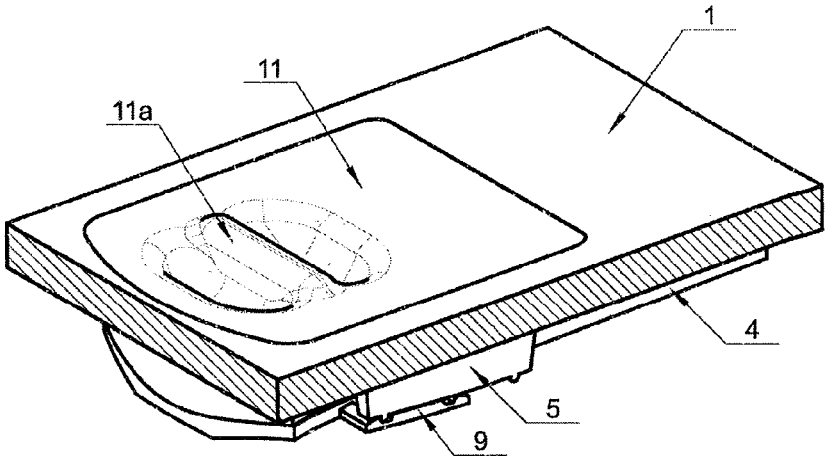
FIG. 15—shows the mechanism in the closed position, as in FIG. 5 and FIG. 6, with an additional sealing and actuating tongue, in a 3D view from the top.
Figure 16:
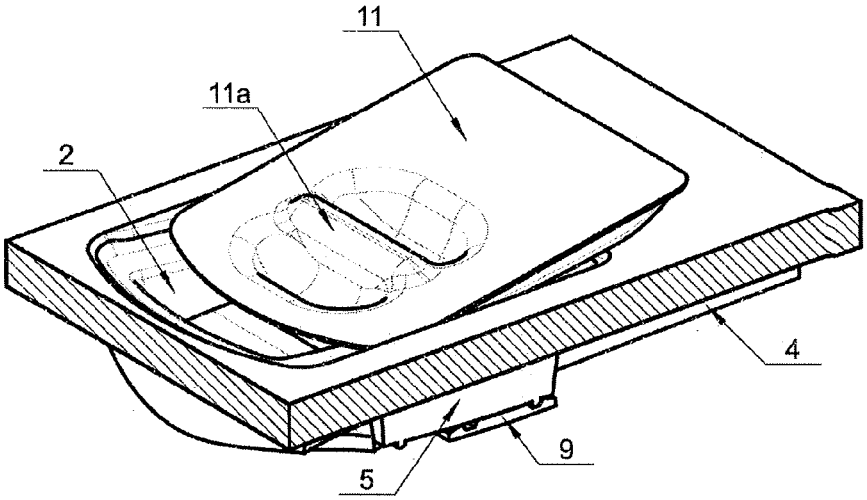
FIG. 16—depicts the mechanism in the open position, as in FIG. 15, in a 3D view from the top.
Figure 17:
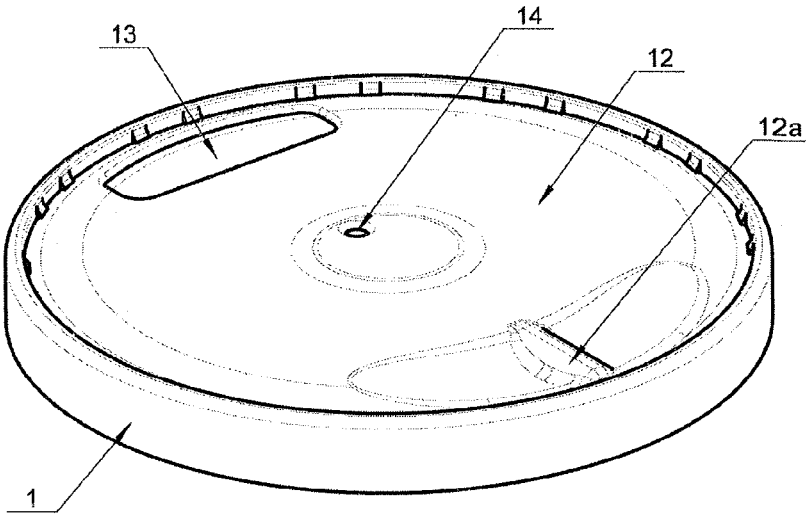
FIG. 17—presents the mechanism in the closed position, as in FIG. 5 and FIG. 6, with an additional rotating sealing and actuating cap, in a 3D view from the top.
Figure 18:
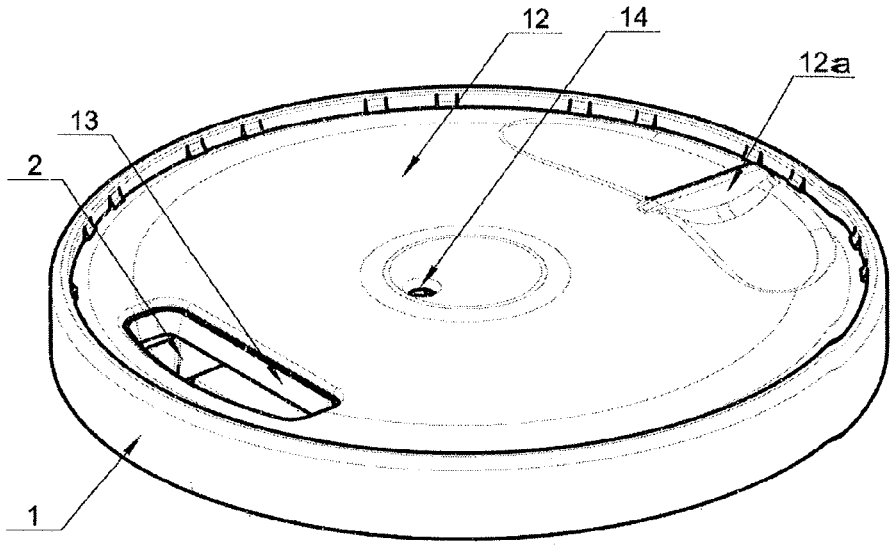
FIG. 18—presents the mechanism in the open position, as in FIG. 17, in a 3D view, from the top.
Figure 19:
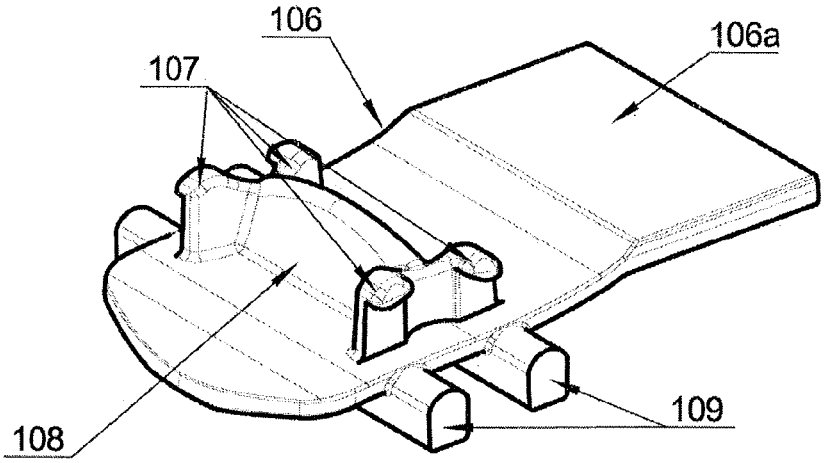
FIG. 19—depicts the latch in a 3D view from the top, with two pairs of hatching elements.

Moreover, formed on the top surface of the latch is an element 8 for initiating movement of the latch, as shown in FIG. 1, and the latch can be fitted with an additional sealing and actuating tongue 11 with an gripping rib 11*a* formed thereon for setting the latch in motion, where the tongue 11*a* is fitted on the said element 8, as shown in FIG. 15 and FIG. 16; optionally, the latch can be fitted with an additional rotating sealing and actuating cap 12 with an gripping rib 12*a* formed thereon for setting the latch in motion, cooperating with the said element 8 of the latch. Moreover, the said rotating cap 12 features an opening 13 for emptying the container, and an opening 14 for supplying air to the slit 10 when emptying the container, as shown in FIG. 17 and FIG. 18.

Figure 20:
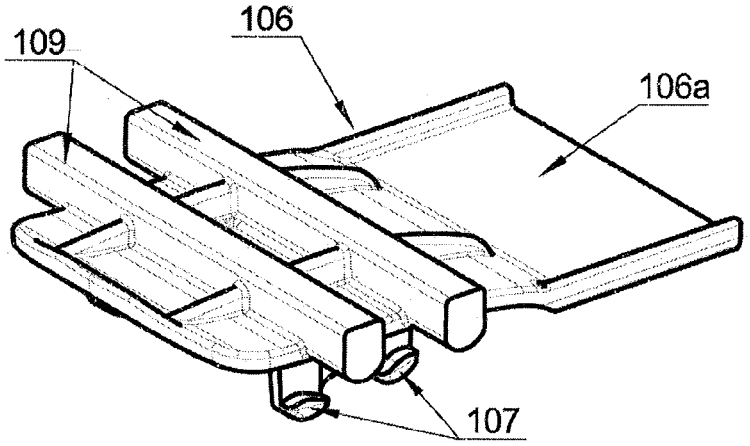
FIG. 20—depicts the latch as in FIG. 19, in a 3D view from the bottom.
Figure 21:
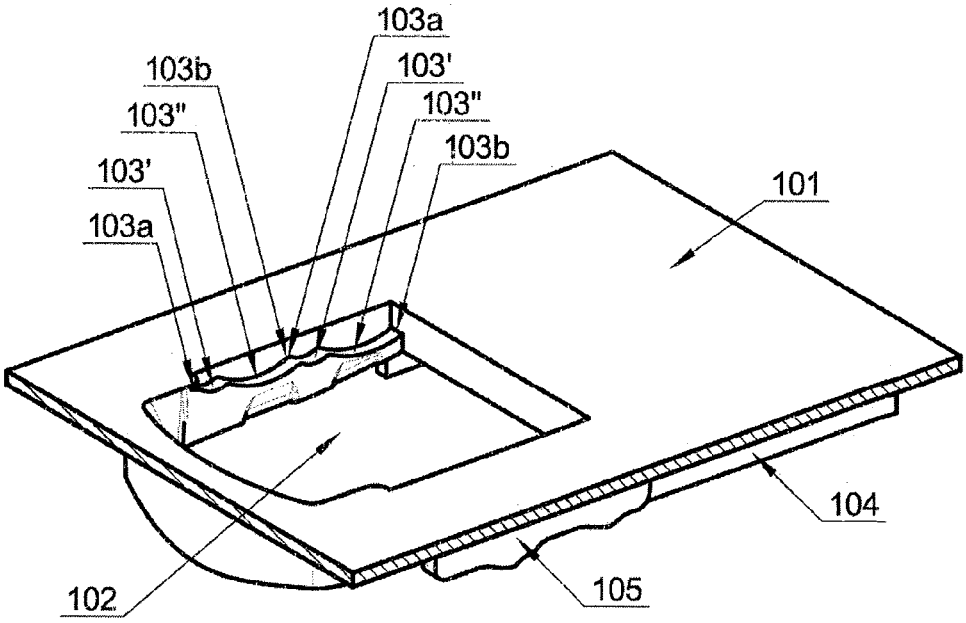
FIG. 21—presents the part of the lid with the outflow opening for emptying the container, for the latch as in FIG. 19 and FIG. 20, in a 3D from the top.
Figure 22:
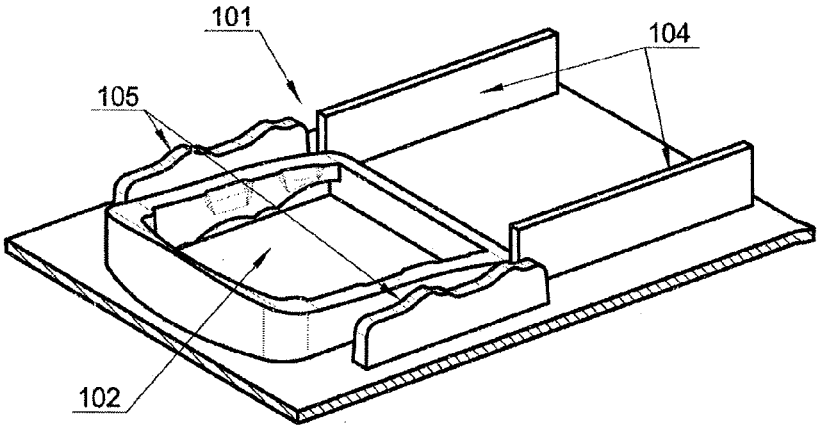
FIG. 22—presents the part of the lid with the outflow opening for emptying the container, as in FIG. 21, in a 3D view from the bottom.

In the second exemplary embodiment of the invention, presented in FIG. 19 to FIG. 32, the mechanism incorporates the latch 106 for the opening and reclosing of the said outflow opening 102 in the lid 101 of the container. The latch 106 is fitted with two pairs of hatching elements 107 (as shown in FIG. 20), and the lid 101 features two pairs of sliding surfaces 103 formed on the side longitudinal walls of the opening 102, serving as the guides for the hatching elements 107 when the latch 106 is in motion. The sliding surfaces 103 of each specific pair are positioned parallel to each another, and the pairs of the sliding surfaces 103 are positioned one pair after another in the direction of movement of the latch 106, as shown in FIG. 21. Moreover, the sliding surfaces 103 in each pair are formed of two convex arched sections 103' 103" of different radiuses, as shown in FIG. 21. Ends of the arched surfaces 103 of each pair are positioned at different heights with respect to the bottom surface of the lid 101 around the opening 102, where the ends of the pair of the arched surfaces 103*a* from which the movement of the latch starts towards the opening of the outflow opening are positioned higher than the other ends 103*b* of the specific pair, i.e. at a slope down in the direction in which the latch 106 moves towards the open position, and where the end of the arched surface of each arched section 103', 103" from which the movement of the latch 102 starts towards the opening of the outflow opening 102 is positioned higher than its other end, i.e. at a slope down in the direction in which the latch 106 moves to the open position. In each pair of the sliding surfaces 103 the arched sections 103' from which the movement of the latch 106 starts towards the opening of the outflow opening 102 are shorter than that of the immediately following arched sections 103", and the radius of the arched sections 103' from which the movement of the latch 106 starts towards the opening of the outflow opening 102 is smaller than the radius of the curve of the immediately following arched sections 103".

Figure 23:
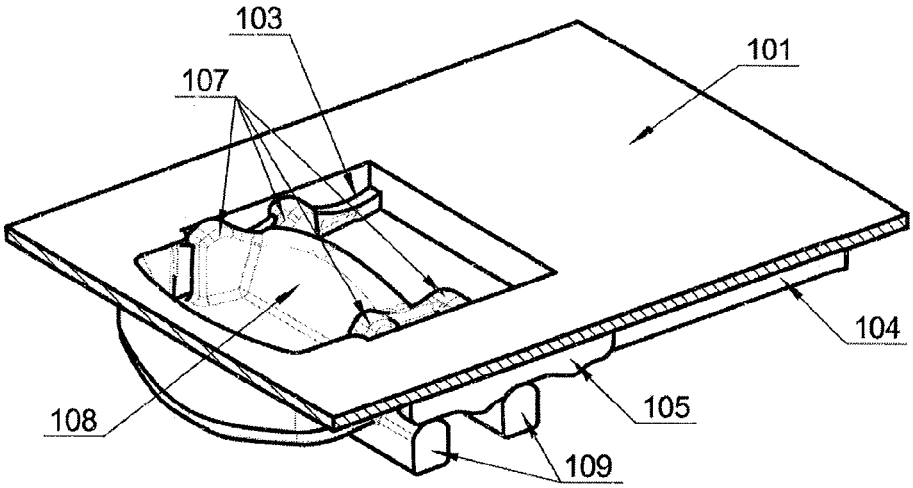
FIG. 23—shows the mechanism incorporating the latch as in FIG. 19 and FIG. 20, fitted in the lid as in FIG. 21 and FIG. 22, in the closed position, in a 3D view from the top.
Figure 24:
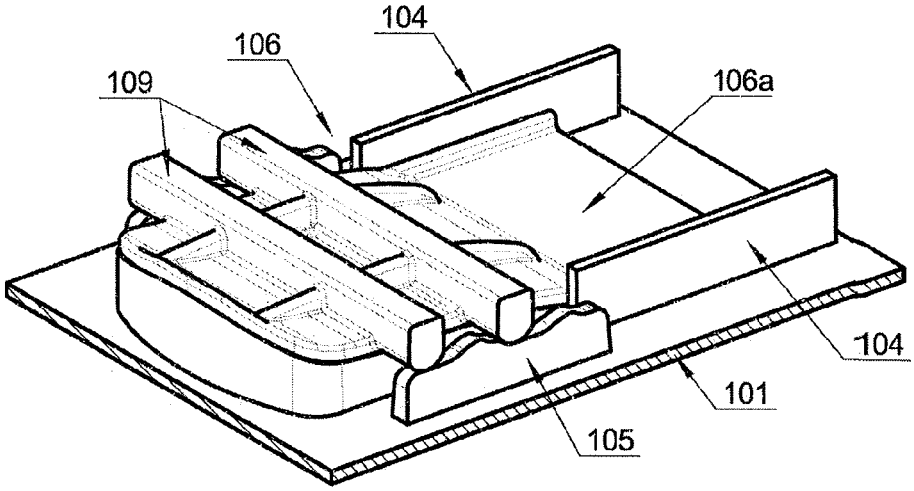
FIG. 24—shows the mechanism in the closed position as in FIG. 23, in a 3D view from the bottom.
Figure 25:
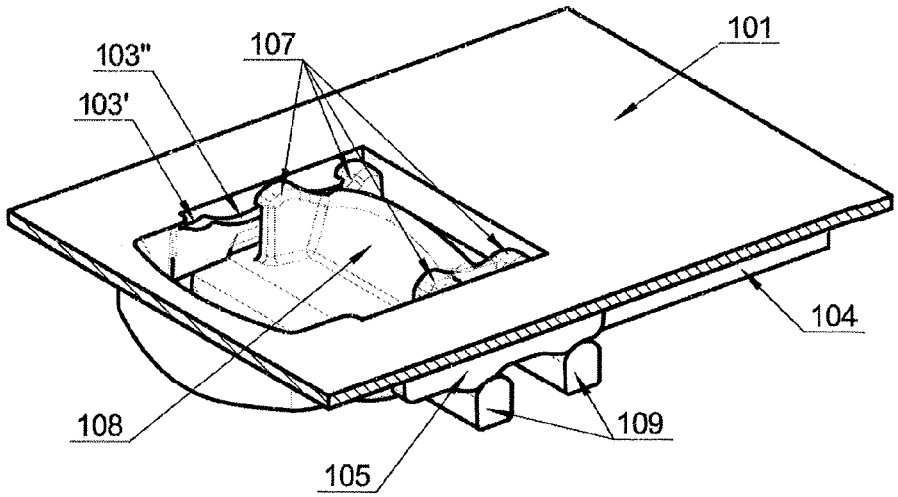
FIG. 25—depicts the mechanism incorporating the latch as in FIG. 19 and FIG. 20, fitted in the lid as in FIG. 21 and FIG. 22, in the open position, in a 3D view from the top.
Figure 26:
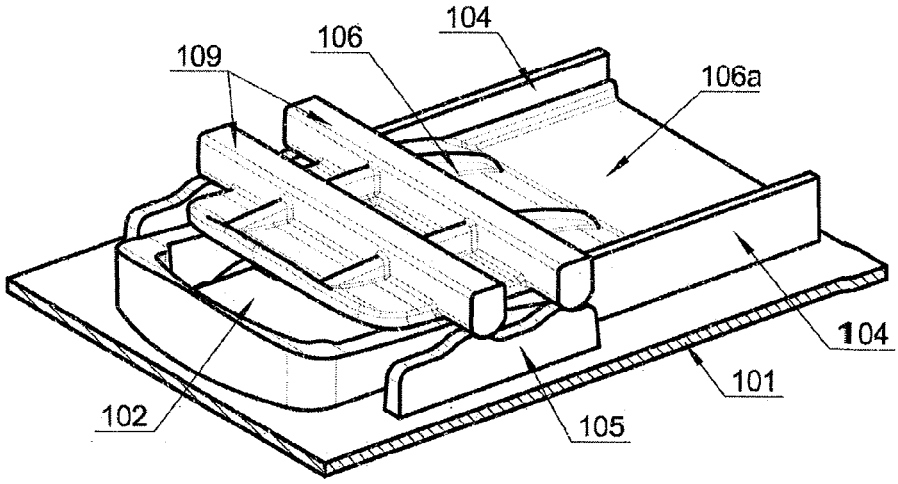
FIG. 26—presents the mechanism incorporating the latch as in FIG. 19 and FIG. 20, fitted in the lid as in FIG. 21 and FIG. 22, in the open position, in a 3D view from the bottom.

Each pair of the hatching elements 107 is fitted slidingly on a single pair of the said sliding surfaces 103 which serve as guides for these hatching elements 107 when the latch is in motion, as shown in FIG. 23 and FIG. 25. One pair of the hatching elements 107 cooperates with one pair of the sliding surfaces 103.

Figure 27:
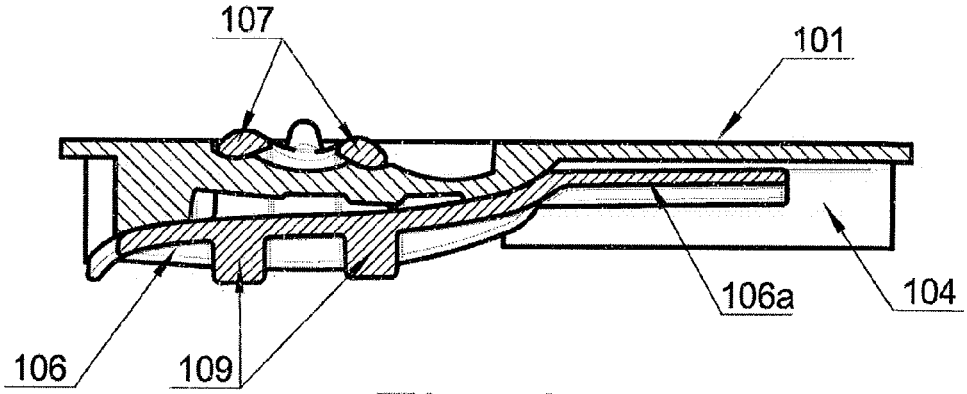
FIG. 27—shows the mechanism in the closed position, as in FIG. 23 and FIG. 24, in cross-section along the opening.
Figure 28:
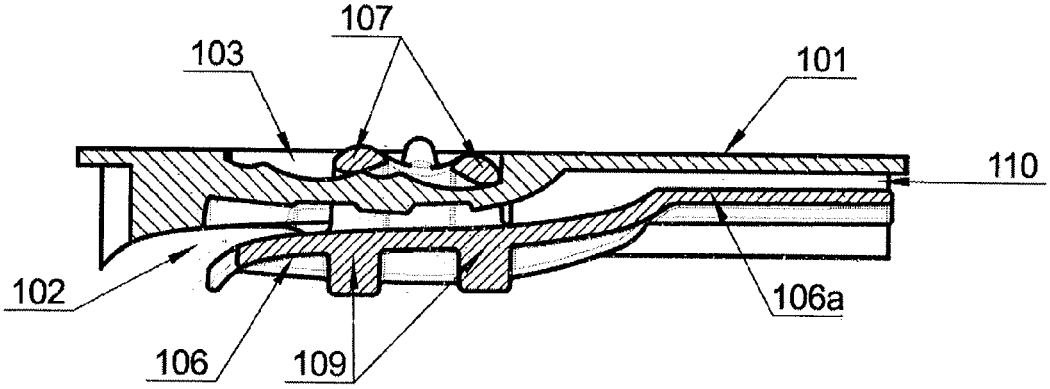
FIG. 28—shows the mechanism in the open position, as in FIG. 25 and FIG. 26, in cross-section along the opening.
Figure 29:
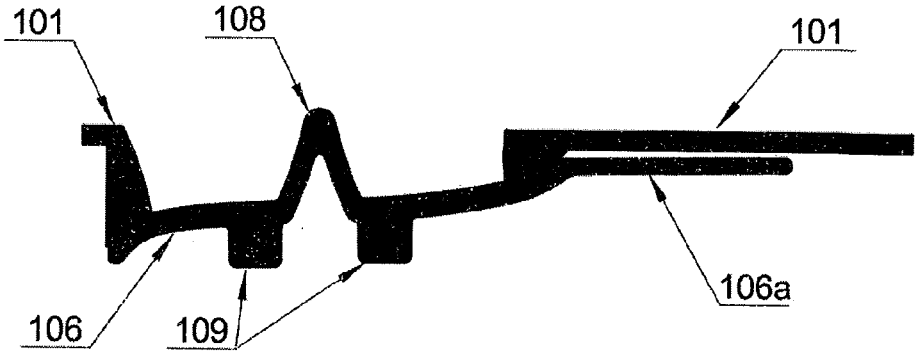
FIG. 29—presents a schematic cross-section of the mechanism in the closed position, as in FIG. 23 and FIG. 24.
Figure 30:
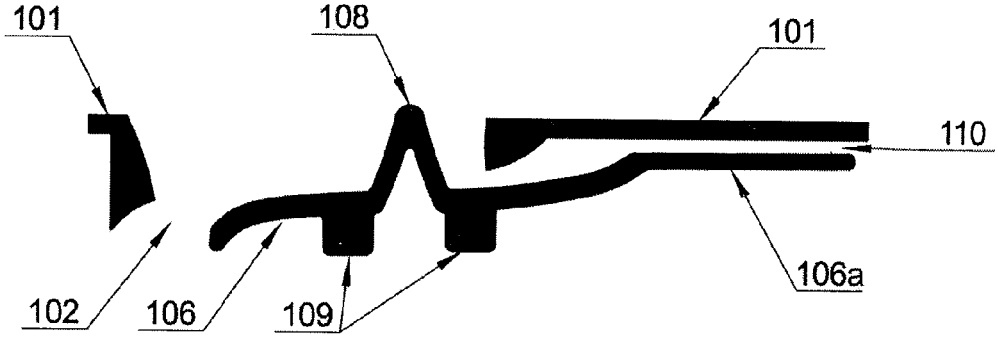
FIG. 30—depicts a schematic cross-section of the mechanism in the open position, as in FIG. 25 and FIG. 26.
Figure 31:
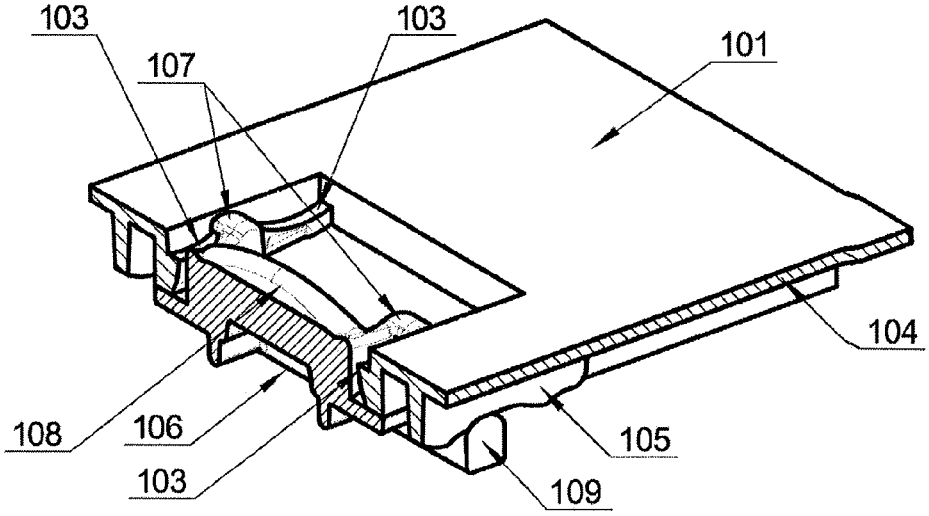
FIG. 31—depicts the mechanism in the closed position, as in FIG. 23 and FIG. 24, in a 3D cross-section across the opening.
Figure 32:
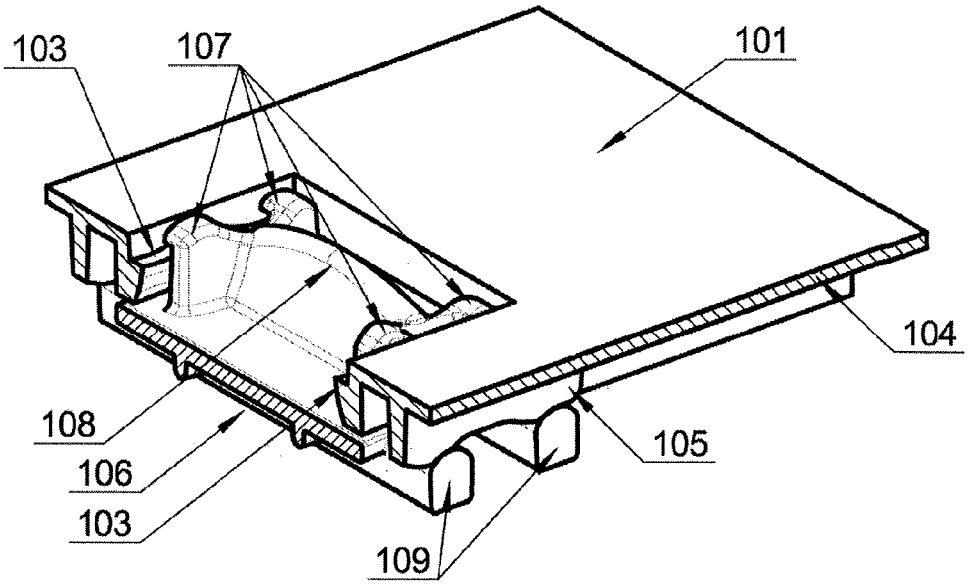
FIG. 32—presents the mechanism in the open position, as in FIG. 25 and FIG. 26, in a 3D cross-section across the opening.

In the closed position, the latch 106 touches on the bottom surface of the lid 101 around the opening, as shown in FIG. 27, and in the open position it is distant from the bottom surface of the lid 101, as shown in FIG. 28.

Formed on the bottom surface of the lid 101 are longitudinal ribs 104, positioned in between which is the end part 106*a* of the latch 106, so that formed between the lid 101 and the end part 106*a* of the latch 106, and between the said ribs 104 is a slit 110 to supply air into the container during its emptying, as shown in FIG. 28. Formed on the bottom surface of the lid 101 is a pair of longitudinal distancing elements 105, and formed on the bottom surface of the latch 106 are two transverse distancing elements 109 which cooperate with the said pair of the distancing elements 105 of the lid 101. In addition, formed on the top surface of the latch 106 is an element 108 in the form of a gripping rib for initiating movement of the latch.

In the invention embodiments described above, the container, lid, and mechanism are all made of the same plastic.

When the opening 2, 102 is being opened, the latch 6, 106 moves downwards, towards the inside of the container. When the movement of the latch 6, 106 towards the opening of the outflow opening 2, 102 is initiated, the latch gets immediately moved downwards, towards the inside of the container thanks to the arched shapes of the sliding surfaces 3, 103 which cooperate with the hatching elements 7, 107, and the slit 10, 110 through which air is supplied into the container opens up to the opening 2, 102. Further shifting of the latch 6, 106 towards the opening of the outflow opening 2, 102 causes further downward movement of the latch 6, 106 and increases the distance between the top surface of the latch 6, 106 and the bottom surface of the lid 1, 101 around the opening. The flow of air into the container through the slit 10, 110 ensures laminar flow of beverage out of the container. The shaping of the sliding surfaces 103 into two arched sections 103' and 103" makes it possible to reclose the opening 102 tightly. The first shorter arched section 103' of the sliding surfaces 103, the radius of which is smaller than that of the second section 103", ensures immediate downward movement of the latch 106 during the opening of the outflow opening 102 and distancing the top surface of the latch 106 from the bottom surface of the lid 101.

The mutually cooperating distancing elements of the lid and the latch stabilise the movement of the latch during opening and reclosing of the outflow opening.

LIST OF NUMERICAL REFERENCES

1—part of the lid with the outflow opening for emptying the container
2—outflow opening for emptying the container
3—sliding arched surfaces
3*a*, 3*b*—ends of the sliding arched surfaces
4—longitudinal ribs of the lid
5—distancing elements of the lid
6—latch
6*a*—end part of the latch
7—hatching elements of the latch
8—element to initiate the movement of the latch
9—distancing elements of the latch
10—slit
11—sealing and actuating tongue
11*a*—gripping rib of the actuating tongue to initiate the movement of to shift?] the latch
12—rotating sealing and actuating cap
12*a*—gripping rib of the rotating cap to initiate the movement of the latch
13—opening in the cap for emptying of the container
14—opening in the cap to supply air to the container during the emptying of the container
101—part of the lid with the opening to empty the container
102—opening to empty the container
103—sliding arched surfaces
103*a*, 103*b*—ends of the sliding arched surfaces
103', 103"—sections of the sliding arched surfaces
104—longitudinal ribs of the lid
105—distancing elements of the lid
106—latch

106*a*—end part of the latch
107—hatching elements of the latch
108—element to initiate the movement of the latch
109—distancing elements of the latch
110—slit to supply air to the container during its emptying

The invention claimed is:

1. A mechanism for opening and reclosing the outflow opening for emptying a container, especially a beverage container, comprising a latch to open and reclose the said outflow opening in a container lid, wherein the latch is fitted with hatching elements connected slidingly to the container lid, and wherein the lid features an actuating element for initiating movement of the latch form on the top surface of the latch, characterised in that it contains at least one pair of sliding surfaces (3, 103), each of them incorporating at least one section in the shape of a convex arch going down with a respect to a top surface of the lid (1, 101), where moving on said pair of sliding surfaces (3, 103) when shifting the latch (6, 106) is at least one pair of hatching elements (7, 107) formed on the top surface of the latch (6, 106), and where ends (3*a*, 3*b*, 103*a*, 103*b*) of the sliding surfaces (3, 103) are positioned at different heights with respect to the bottom surface of the lid (1, 101) around the outflow opening (2, 102), so that the end (3*a*, 103*a*) of each sliding surface (3, 103) from which the movement of the latch (6, 106) starts towards the opening of the outflow opening (2, 102) is positioned higher relative to the bottom surface of the lid (1, 101) around the outflow opening (2) than its other end (3*b*, 103*b*), and where the latch (6, 106) in the closed position contacts the bottom surface of the lid (1, 101) around the outflow opening (2, 102), and wherein the latch (6, 106) is moved downwards relative to the bottom surface of the lid (1, 101) around the outflow opening (2) to the open position so that in the open position the latch (6, 106) is distant from the bottom surface of the lid (1, 101) around the outflow opening (2).

2. The mechanism according to claim 1, characterised in that it contains two pairs of sliding surfaces (103) positioned one after another in the direction of movement of the latch (106), and two pairs of hatching elements (107), where one pair of the hatching elements (107) cooperates with one pair of the sliding surfaces (103).

3. The mechanism according to claim 1, characterised in that the sliding surface (3, 103) of at least one pair is made up of two sections in the shape of a convex arch going down with a respect to the top surface of the lid (1,101).

4. The mechanism according to claim 1, characterised in that there are longitudinal ribs (4, 104) formed on the bottom surface of the lid (1, 101), and there is an end part (6*a*) formed on the latch (6) and placed in between the said ribs (4, 104) of the lid (1), so that a slit (10, 110) is formed between the lid (1, 101) and the end part (6*a*, 106*a*) of the latch (6, 106).

5. The mechanism according to claim 1, characterized in that formed on the bottom surface of the lid (1, 101) is at least one pair of distancing elements (5, 105), and the latch (6, 106) features at least one distancing element (9, 109) on its bottom surface, where the distancing element of the latch cooperates with the said pair of the distancing elements (5, 105) of the lid (1, 101).

6. The mechanism according to claim 1, characterised in that the latch (6) is fitted with an additional sealing and actuating element connected to the said element (8) which initiates movement of the latch (6), preferably a tongue (11) or cap (12).

7. The mechanism according to claim 1, characterized in that it is made of plastic.

* * * * *